US006223637B1

(12) United States Patent
Hansen

(10) Patent No.: US 6,223,637 B1
(45) Date of Patent: May 1, 2001

(54) CATHETER SIDE-WALL HOLE CUTTING METHOD AND APPARATUS

(76) Inventor: Peter T. Hansen, 1460 Harrison Ave., Salt Lake, UT (US) 84105

( * ) Notice: Subject to any disclaimer, the term of this patent is extended or adjusted under 35 U.S.C. 154(b) by 0 days.

(21) Appl. No.: 09/482,184

(22) Filed: Jan. 12, 2000

Related U.S. Application Data

(63) Continuation-in-part of application No. 08/721,504, filed on Sep. 26, 1996, now Pat. No. 6,035,750

(60) Provisional application No. 60/005,476, filed on Oct. 16, 1995.

(51) Int. Cl.[7] ..... B26D 7/18; B26F 1/00

(52) U.S. Cl. ..... 83/24; 83/100; 83/684; 83/698.91; 30/124; 30/316; 30/358

(58) Field of Search ..... 83/100, 24, 684, 83/698.91; 30/316, 358, 130, 124, 125

(56) References Cited

U.S. PATENT DOCUMENTS

| | | | | |
|---|---|---|---|---|
| 2,424,474 | | 7/1947 | MacGregor . | |
| 2,463,455 | | 3/1949 | Dann . | |
| 4,010,543 | | 3/1977 | Nusbaum . | |
| 5,026,384 | * | 6/1991 | Farr et al. | 606/159 |
| 5,250,059 | * | 10/1993 | Andreas et al. | 606/159 |
| 5,431,673 | * | 7/1995 | Summers et al. | 606/170 |
| 5,728,129 | * | 3/1998 | Summers | 606/170 |

* cited by examiner

*Primary Examiner*—M. Rachuba
*Assistant Examiner*—Sean Pryor
(74) *Attorney, Agent, or Firm*—Brian C. Trask

(57) ABSTRACT

A hole cutter adapted for cutting holes through the sidewalls of medical catheters is fashioned from a hollow tube having a distal cutting end, a proximal ejection end and a lumen of smaller diameter near the cutting end. Slugs formed at the cutting end are extracted by suction applied to the ejection end, and are captured by a filter.

20 Claims, 2 Drawing Sheets

CATHETER SIDE-WALL HOLE CUTTING METHOD AND APPARATUS

BACKGROUND OF THE INVENTION

Related Applications

This application is a continuation-in-part of application Ser. No. 08/721,504 filed Sep. 26, 1996 now U.S. Pat No. 6,035,750 and claims the benefit under 35 U.S.C. 119(e) of the filing date of Provisional Application Serial No. 60/005,476, filed Oct. 16, 1995 for HOLE CUTTER WITH VACUUM REMOVAL.

1. Field

This invention relates to hole cutting apparatus. It is specifically directed to hollow punches and hole cutters. It provides an improved means for ejecting and capturing discard slugs produced by such punches and cutters.

2. State of the Art

Many types of hole cutters and punches of specialized design are known. Special purpose cutters are often required for specific applications or for use with particular materials. There are various known techniques available for forming a hole in a material. A suitable hole may often be provided by punching through a material with a solid or hollow punch. In some applications, an acceptable hole is formed by applying pressure, and frequently impulse force, to a solid punch to knock out a "slug," leaving a hole in the material. Other applications utilize a hollow punch to remove a core or slug from a piece of material. The material to be cut may be placed between the hollow punch and a supporting substrate. The punch, which is typically in the form of a hollow tube with a distal cutting edge, is pressed down upon the material, which shears along the cutting edge. A slug of material is removed with the punch, leaving a hole through the material. U.S. Pat. No. 4,010,543 to Nusbaum discloses a typical special purpose hollow tube device of this type.

Hollow punches are often round, and can thus be rotated to cut a hole. They are then typically referred to as "tube cutters." Rotation of the cutter during hole formation reduces burrs around the edge of the resulting hole. Moreover, suitable holes can be formed with rotating cutters without the use of a supporting substrate.

Proper selection of a cutter or punch is necessarily dependent upon the nature and dimensions of the material to be cut. For example, if the material is thin and stiff, such as paper or cardboard, a hole puncher can be utilized. On the other hand, removing the core of a fruit, such as an apple, is better accomplished through use of a hole cutter.

Punch shapes vary according to specific requirements. Round shapes are most common, although oblong, elliptical, and square punches are also common. Rotating cutters are ordinarily utilized for forming substantially round holes.

Medical catheters are an example of a hole cutting operation in which proper retrieval or disposal of discard (slug) material is important. Holes are often cut through plastic catheter tubing transverse the tubing's lumen. Catheters are routinely inserted into the circulatory or respiratory systems of a patient. It is thus important that the catheter not be a source of debris. Catheters are variously used to deliver and extract fluid from the blood stream, enter the peritoneal cavity for dialysis, sense pressure inside blood vessels near the heart, and monitor contraction pressure during child birth. Slugs that are not removed from the catheter may become lodged in the body. Present practice involved in the cutting of holes in medical catheters relies upon the slug's remaining inside the hollow cutter tube through frictional engagement with the interior surface of the cutter. The slug is later pushed out of the distal (cutting) end of the cutting tube with a rod, which is inserted from the proximal (or opposite) end of the cutting tube. This slug-ejection method tends to result in a scattering of slugs in the cutting area. Occasionally, ejected slugs cling to the outside of the catheter tubing. Furthermore, the added motion required for the ejection step increases the time needed to make a hole, and increases the complexity of the machinery required for hole cutting. A slug may also remain in the lumen of the catheter because the slug is not frictionally engaged by the interior surface of the cutter.

SUMMARY

The present invention provides a hole cutting method and apparatus which avoids the shortcomings of previous devices with respect to slug disposal. The invention provides a hole cutting apparatus capable of forming holes of circular or various non-circular shapes in soft materials. A notable benefit offered by the present invention is an improved system for extracting slugs from a cutter.

The hole cutting apparatus of the present invention finds particular use in cutting plastic tubes. The present apparatus provides a slug ejection system which removes the slug through the center of the hollow hole cutter for effective transport to a filter or slug trap for convenient disposal. The apparatus of this invention may be embodied as either a punch or a rotating cutter. In any case, it may be particularly adapted for cutting holes through the sidewalls of medical catheters.

Generally, this invention provides a hole cutting apparatus comprising a hollow tube having a distal (cutting) end terminating in a cutting edge, a proximal (ejection) end, a lumen extending between the distal and proximal ends, the lumen being of smaller diameter near the distal end than at the proximal end, and ejection means constructed and arranged for urging a slug of material from the distal end towards the proximal end.

The ejection means presently preferred in practice is suction applied to the proximal end of the tube. Any mechanism effective to extract discard slugs from the proximal end of the tube could be substituted. An important characteristic of this invention is the extraction, or ejection, of discard slugs away from the cutting end of the cutter. Ideally, a moving air stream carries the slugs out of the cutting tube and transports them to a capturing or collection device, such as a filter.

Preferably, the lumen includes a first portion, extending from the cutting edge to a shoulder, and a second portion, extending from the shoulder to the proximal end. The first portion will have a cross sectional configuration substantially congruent with a preselected cross sectional shape of a discard slug. The second portion should have a cross sectional configuration which permits free travel of a slug from the shoulder to the proximal end. Assuming that the cutter is embodied as a hollow punch of circular cross sectional configuration, both the first and second portions of the lumen will typically have circular cross sectional configurations, with the second portion having a somewhat larger diameter. Usually, the two cross sections are substantially concentric, but other arrangements are operable.

To maintain unobstructed flow of ejection fluid (typically air) through the cutter, at least one aperture may be provided in the side wall of the cutter tube, communicating with the lumen near the distal end of the tube. In certain embodiments, at least one such aperture communicates with the lumen at the shoulder. The cross sectional area of the aperture(s) are typically about ⅓ the cross sectional area of the lumen of the catheter to assure adequate fluid flow through the lumen to extract the slug. The apertures are ideally located about one to about three slug thicknesses from the distal end of the cutter. The width of an aperture should be small enough, typically less than about ⅓ of a slug diameter, to avoid lodging of a slug edge in an aperture.

In an alternate and currently preferred configuration, no apertures are provided in the side wall of a cutter tube. Fluid flow is interrupted by the presence of a tube side wall, such as a catheter side wall, during the cutting operation. The fluid flow through the cutter tube is restored upon separation of the discard slug from the catheter side wall. The restored fluid flow then carries the slug away from the catheter and ejects the slug from the discard end of the cutter tube.

To form a burr-free hole on an external surface of a catheter, it is preferred to punch a partial depth hole without rotation of a cutting edge, then to rotate the cutting edge during the remainder of the cutting stroke. The initial nonrotating punch stroke cold works surface material of the catheter side wall, and prevents a surface burr. Rotation of the cutting edge on the remainder of the stroke to finish the hole cutting operation improves the cutting function of the cutter. A rotating cutting edge places a reduced transverse force on a catheter and helps ensure separation of a slug from the catheter side wall. Effectively, rotation of the cutting edge reduces the possibility of uncut material forming a hinge to attach the slug and catheter. It is also beneficial to align the cutter and catheter to have intersecting centerlines during the cutting operation, such as by fixturing the catheter in a cradle. However, the preferably applied suction helps prevent hinging action of a slug during a cut, even if catheter and cutter centerlines are not completely aligned in intersection.

The invention thus provides an improvement in the method of cutting a hole in material by forcing the distal end of a hollow cutting tube through the material to remove a discard slug, removing the tube and slug from the material, and ejecting the slug from the tube. This improvement broadly comprises providing the cutting tube in the form of a hollow tube having a lumen, extending between the distal and proximal ends of the tube, the lumen being of smaller diameter near the distal end than at the proximal end, and ejecting slugs of material from the proximal end of the tube. The lumen preferably has a distal portion of smaller cross sectional area than a proximal portion.

In one cutting tube arrangement, the distal portion is defined by a shoulder positioned a distance from the cutting edge approximately equal to the thickness of one or two of the discard slugs. "Approximately equal," in this context is intended to include distances substantially smaller to slightly larger than (sometimes, up to twice) the slug thickness. The function of this reduced diameter portion is to provide a frictional interface between the slug and the lumen sufficient to hold the slug in position until it is forced into the enlarged portion during subsequent cutting operations. In another cutting tube arrangement, the distal portion varies in diameter, increasing from one diameter at a cutting edge to a second diameter at a location interior the cutting tube. In yet another cutting tube arrangement, the distal portion is defined by a shoulder positioned a distance from the cutting edge less than one thickness of a discard slug.

BRIEF DESCRIPTION OF THE DRAWINGS

In the drawing, which illustrates what is currently regarded as the best mode for carrying out the invention.

DETAILED DESCRIPTION OF THE ILLUSTRATED EMBODIMENT

Figure 1:
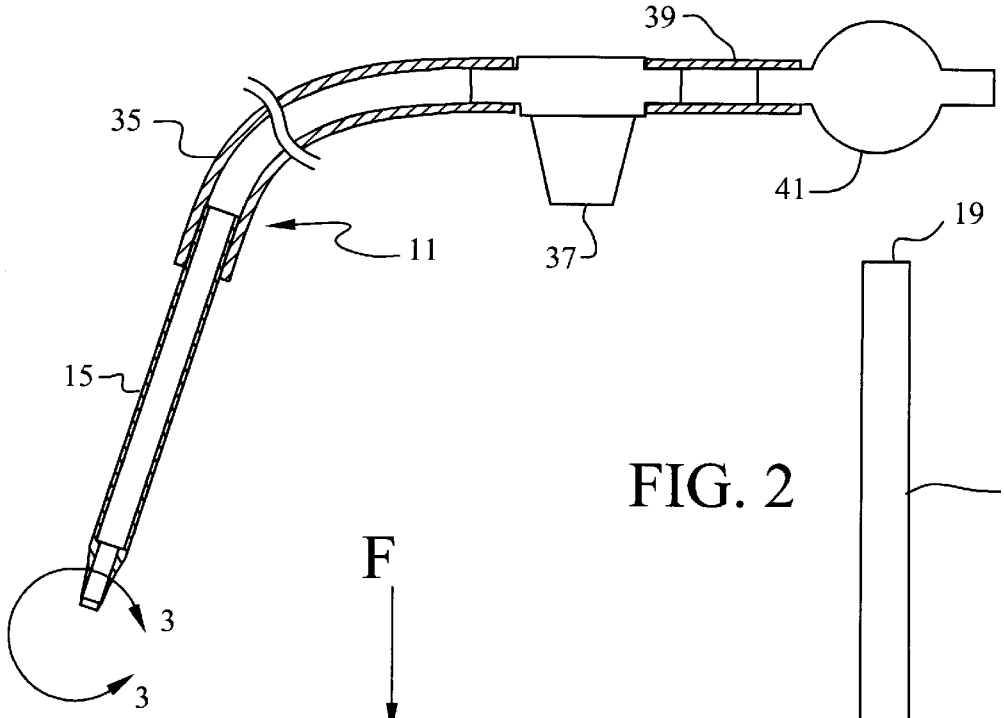
FIG. 1 is a view in side elevation, partially in section, of a cutting apparatus of this invention.
Figure 2:
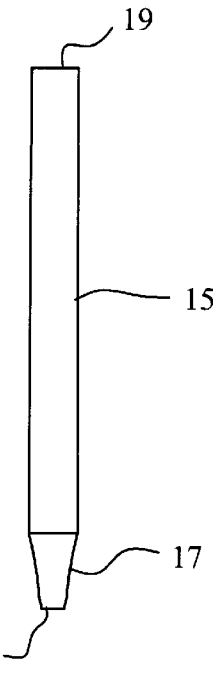
FIG. 2 is a view in elevation of a cutter tube element of the apparatus of FIG. 1.

A hole cutting device, generally 11 (FIG. 1), includes a hollow, shaft-like tube 15 having a bottom (distal) end 17 and top (proximal) end 19 (FIG. 2). The distal end 17 terminates in a cutting edge 21 of significantly reduced wall thickness. The edge 21 may be formed by chamfering either or both the inside and outside surfaces of the tube 15.

Figure 3:
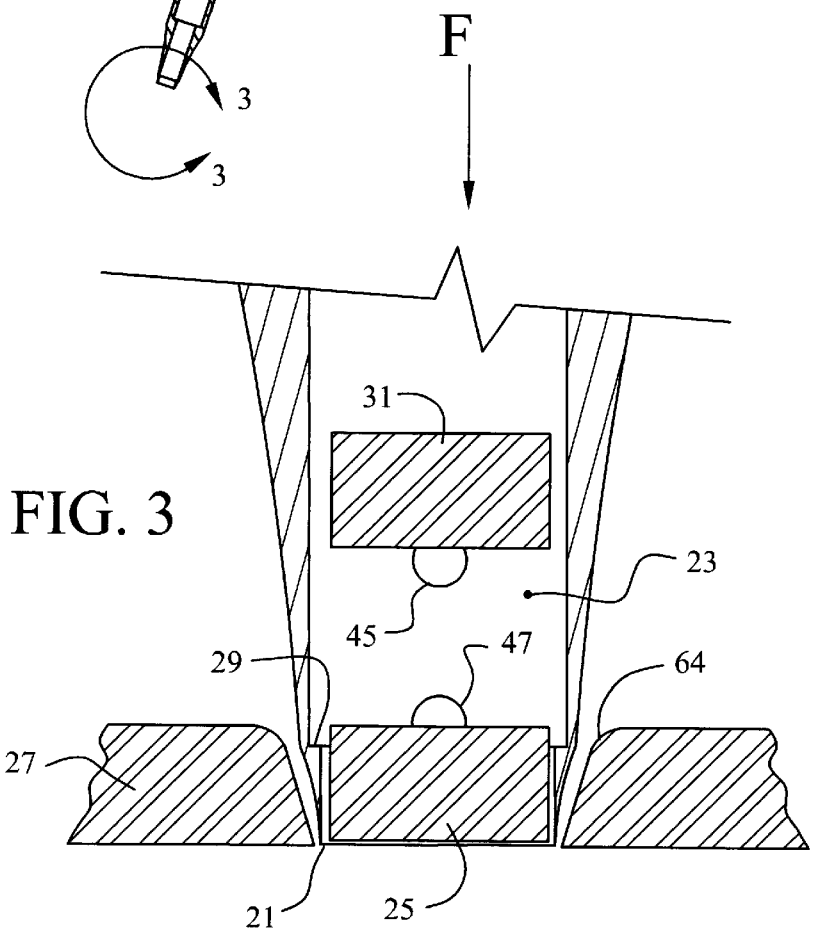
FIG. 3 is an enlarged view of a portion of FIG. 1 designated by the line 3—3, shown in working position with respect to a work piece.

As best shown by FIG. 3, the diameter of the lumen 23 of the hollow tube 15 at its cutting edge 21 is selected as appropriate to cut a slug 25 of specified size from a work piece 27. This dimension is maintained for a very short portion of the lumen's length, as illustrated, approximately the thickness of a single slug 25. As shown, the lumen 23 assumes a significantly larger diameter at a shoulder 29. The slug 31 is approximately identical in shape and dimension to the slug 25, but while the slug 25 is held within the lumen 23 by frictional resistance, the slug 31 is relieved from frictional contact sufficiently to permit its free travel towards the proximal end 19.

For purposes of illustration, the tube 15 and its lumen 23 are presumed to be circular in cross section so that the discard slugs 25, 31 will inevitably be in the shape of circular cylinders or disks. It is, of course, within contemplation that the tube 15 and lumen 23 be shaped and dimensioned to cut slugs of other cross-sectional configuration.

To facilitate slug ejection and capture, suction may be applied to the lumen 23 at the proximal end 19 of the tube 15. As shown by FIG. 1, a flexible hose 35 connects the hollow tube 15 through a filter 37 and a second length of hose 39 to a vacuum pump 41. Flow is maintained through the lumen 23, even with a slug 25 in residence at the distal end 17 of the tube, by virtue of radial apertures 45, 47. It should be noted that the aperture 47 intersects the lumen 23 at the shoulder 29, where the diameter of the lumen 23 reduces towards the cutting edge 21.

Operation of the apparatus 11 can best be understood with reference to FIG. 3. The tube 15 is first pressed into the material 27 to be cut and is pushed with downward force as shown by the arrow F. Chamfering of the cutting edge 21 facilitates clean cutting of the material 27. The discard from the cutting step, slug 25, will remain in the position shown, at the distal end of the tube 15, because of the friction interface between the slug 25 and the lumen 23. Entry of the slug will inevitably dislodge a previously cut slug 31 up and into the region of the lumen 23, between the shoulder 29 and the proximal end 17, of increased diameter. The previously cut slug 31 is thus no longer held by friction. It is transported up the lumen by a stream of air entering through the vent holes 45, 47. The slug 31 is carried through flexible tube 35 to the filter 37, where it is captured. As the tube 15 is lifted from the material 27, the most recently produced slug 25 will remain in the lumen 23, as shown, until a subsequent hole is cut.

In a typical embodiment of the present invention, the tube 15 may be made of hardened stainless steel. The outer diameter of a tube cutter useful for forming radial holes in medical catheters can typically vary from approximately 1/100 of an inch to approximately 3/8 of an inch. A typical slug diameter is approximately 1/16 inch, varying between about 1/50 to about 5/16 of an inch. Adequate relief for most purposes is provided by enlarging the lumen at 29 by as little as 0.001 inch. A practical tube 15 height is approximately an inch, a useful range being about 7/8 to about 1½ inches, although this dimension is not critical to operability of the invention. These typical dimensions are by way of example only, it being understood that the invention can be applied in environments requiring equipment of much larger or smaller scale.

Figure 4:
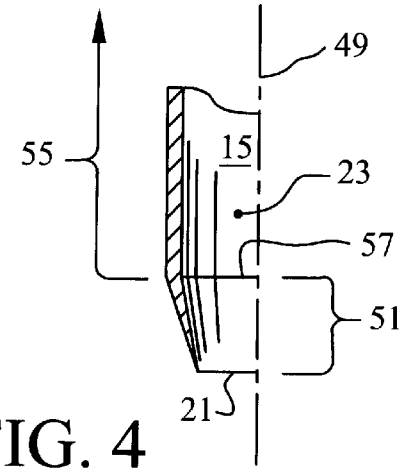
FIG. 4 is a view in cross-section of a portion of an alternate cutter tube element of this invention.
Figure 5:
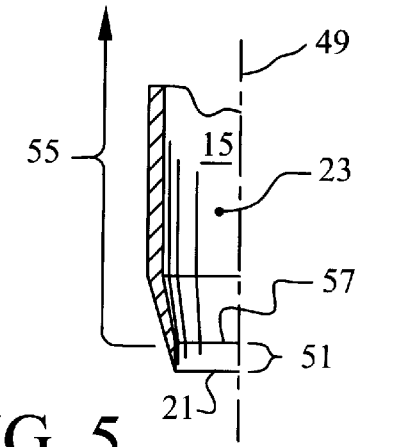
FIG. 5 is a view in cross-section of a portion of an additional alternate cutter tube element of this invention.

Alternative exemplary cutting tubes 15 are illustrated in FIGS. 4 and 5. The illustrations depict cross-section portions of cutting tubes 15 which are symmetric about tube centerlines 49. Of note in the illustrations is the lack of radial apertures 45,47. One characteristic of cutting tubes of the illustrated type is that the discard slug is removed from the distal end portion 51 by an ejection force immediately following separation of the slug from the catheter wall. In a currently preferred application of this type of cutting tube, a discard slug is extracted from distal portion 51 and transported through the proximal end portion 55 by an applied vacuum.

Distal portion 51 is generally defined as that portion of lumen 23 extending in a proximal direction from cutting edge 21 to a shoulder 57. The proximal portion may be defined as that portion from a shoulder 27 extending in a proximal direction to a proximal slug discharge end 19 (FIG. 2). In FIG. 4, shoulder 57 is illustrated as a concave feature formed by the intersection of a cylindrical passageway and an approximately conic section. In FIG. 5, shoulder 57 is illustrated as a convex feature formed by the intersection of a conic section and an approximately cylindrical section. The distal end of the embodiment illustrated in FIG. 5 might be achieved by honing or sharpening the embodiment illustrated in FIG. 4. For the purpose of this disclosure, the term shoulder is meant broadly to apply to structure indicated by a change in cross-section dimension of lumen 23. Such a change in cross-section dimension may be indicated by a visible feature formed by the intersection of distinct surfaces, as illustrated in FIGS. 4 and 5. Such a change in cross-section dimension may also be effected by a gradual change in diameter of lumen 23, seen in cross-section as a radiused or other shaped curve.

The conformation of the shoulder is not critical to the function of the cutting tube. Key structure of cutting tubes such as illustrated in FIGS. 4 and 5 are the distal portion 51 and the proximal portion 55. Distal portion 51 will have a cutting edge to form slugs having a smaller diameter than any diameter in the proximal portion 55. Furthermore, distal portion 51 of an exemplary cutting tube will be structured to release discard slugs, as under an applied vacuum, for transport through lumen 23 following separation of the slug and catheter side wall. Proximal portion 55 will preferably have a self-similar cross-section throughout to promote uniform airflow and ensure consistent transport of a discard slug. The critical characteristic of a proximal portion is that it provides consistent transport of a discard slug. To that end, proximal portions generally have larger cross-section dimensions than the cross-section of a cutting edge. In the case of circular cutting tubes, the diameter of the proximal end will be larger than the diameter of the cutting edge. However, the difference in diameters may be relatively small number. For example, in the smaller size catheter hole cutting tubes, a proximal end portion may be as little as 0.0005 inches larger in diameter than the cutting edge.

The invention is readily adaptable to rotating cutter modes of operation. A system constructed substantially as illustrated by hole cutting machine 60 in FIG. 6 may incorporate a mechanism to impart several degrees of rotation to assist cutting. A suitable rotating coupling mechanism 63 may be incorporated; e.g., at the junction between the tube 15 and the hose 35. The tube 15 may then be driven as a rotating cutter, or even spun in the manner of a hollow drill. In any case, the slug ejection and capturing feature of this invention may be beneficially incorporated.

Verification of slug removal from the catheter may be provided by a sensing element 65. The illustrated sensing element 65 (FIG. 6) is commonly known as an optical sensor, and is arranged to monitor a transparent portion of tube 35. Such a sensor may be placed anywhere between cutting tube 15 and slug filter 37. An optical sensor adaptable for such use would advantageously be able to detect a particle as small as about 0.020 inches or smaller in diameter, and travelling approximately 20 miles-per-hour. One example of a sensor adequate for such use is sold by Keyence Corporation of America as an optical passage conformation sensor. This sensor is sold as two components: a sensor head, model No. PG602, and an amplifier, model No. PG610. Of course, other sensors and sensor configurations are also workable. For example, a pressure transducer may be adapted to record pressure changes in the tube 35. Such pressure changes would correspond to pressure fluctuations caused by obstruction of the distal end orifice by a catheter side wall at the beginning of a cutting operation, and by release of a discard slug from blocking the distal end portion 51 of a cutting tube at the termination of a cutting operation. Alternatively, air flow in the tube 35 could be monitored by a suitable sensor to obtain equivalent slug extraction feedback.

Figure 6:
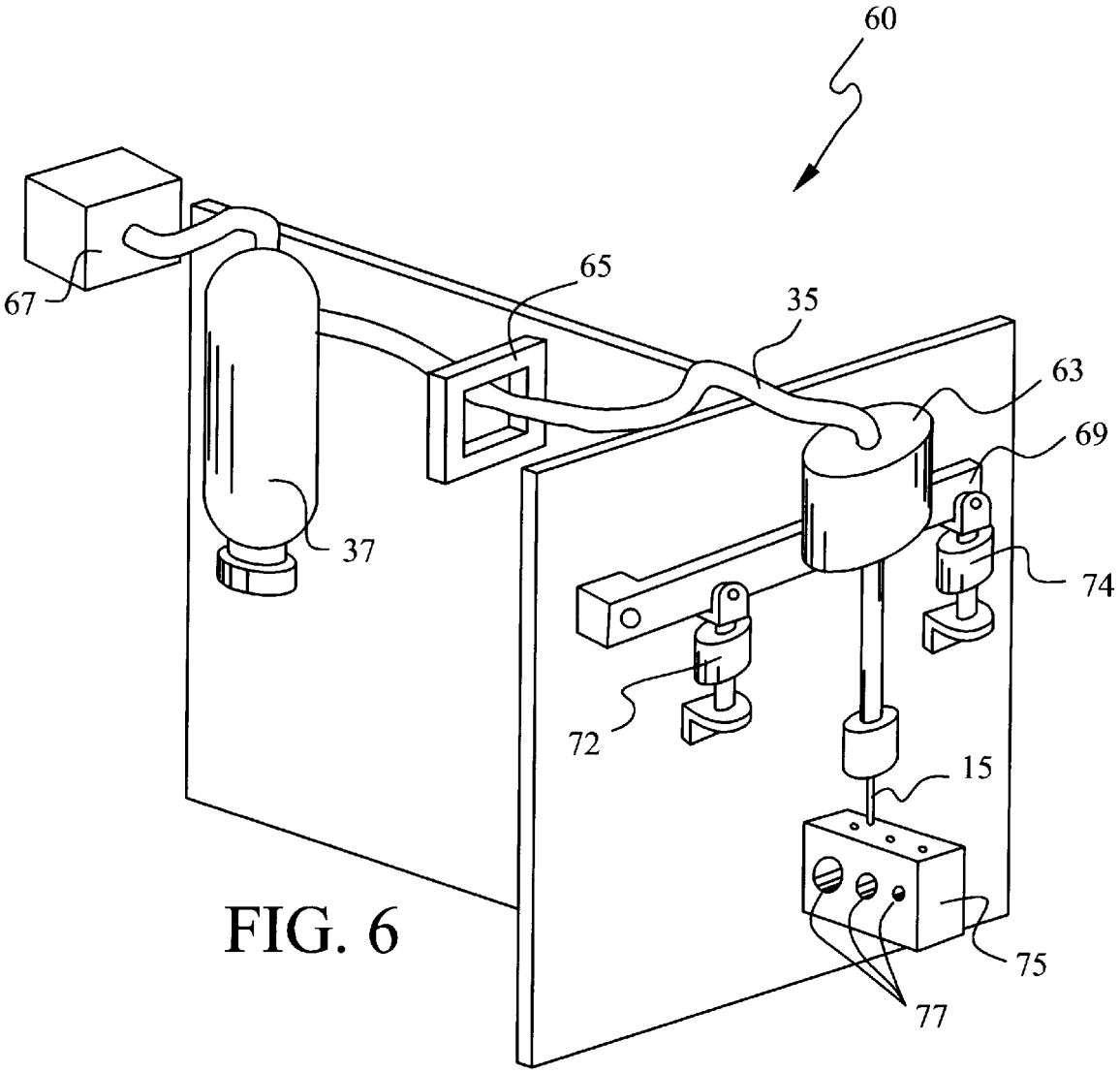
FIG. 6 is a perspective view of an alternate cutting apparatus of this invention.

The invention may be embodied in a hole cutting machine 60 as illustrated in FIG. 6. A cutting tube 15 is coupled to a rotating coupling mechanism 63 having lumen 23 in fluid communication through tube 35 with vacuum source 67. Rotating coupling mechanism 63 is carried on pivot arm 69 to apply a transverse motion to cutting tube 15. The rotation and transverse motion of cutting tube 15 are independent and therefore separately controllable in the illustrated embodiment.

Transverse motion of cutting tube 15 is variably controlled by operation of actuator cylinders 72 and 74. Actuator 72 has a mechanical lever advantage to provide rapid transverse motion to a cutting tube 15. Actuator 72 is positioned on pivot arm 69 to form one example of a fast-acting mechanism to impart relatively rapid linear motion to a cutting tube. Actuator 74 is illustrated with a travel reduction linkage, thereby providing relatively slower transverse motion to a cutting tube 15. Actuator 74 is positioned on pivot arm 69 to form an example of a slow-acting mechanism to impart relatively slow transverse linear motion to a cutting tube. Other mounting arrangements of rotating coupling mechanism 63 are equally operable to achieve desired transverse motion control. For example, rotating coupling mechanism 63 could be affixed to a carriage driven by a ball screw, or other screw actuated mechanism. The ball screw could be turned at a variable rate by a variable speed motor and/or a speed reducing transmission.

Actuator 72 and its linkage amplified stroke is adjusted to bring cutting tube 15 into engagement with the catheter side wall. Preferably, the adjustment is made such that the distal cutting end will penetrate the catheter in a partial depth cut. It is currently preferred for rotating coupling mechanism 63 to begin rotating after the cutting tube 15 makes the partial depth cut. The initial cut made without rotation of the cutting tube 15 cold forms the edge of the hole, resulting in a burr-free exterior surface on the catheter side wall. Pressing a nonrotating cutting tube 15 into a catheter sidewall material 27 can form a hole entry region having a radius 64 (FIG. 3). Typical rotation speed of mechanism 63 is about 1,000 revolutions-per-minute. Rotation speeds may be adjusted to account for hole diameter and catheter material of composition. The remaining transverse cutting stroke is controlled by actuator 74. The length of the cutting stroke imparted by actuator 74 is generally adjusted to correspond to the thickness of the particular catheter being cut. Rate of transverse motion of a cutting edge 21 during a typical cutting operation is generally on the order of a few thousandths of an inch per second. Rotating cutting tube 15, along with a slow feed rate, promotes a burr-free exit to the hole through the catheter side wall.

During the hole cutting process, a catheter (not illustrated) may be supported by a cradle 75. The catheter slides into a corresponding diameter-sized receiving passage 77 through cradle 75. The cradle is adjustably located to align in intersection the catheter and the cutting tube centerlines. Orienting the centerlines in intersection promotes a symmetric exit of the cutting tube through the catheter side wall. Such an arrangement minimizes chances of the slug forming a hinge on the last portion to be cut from a catheter side wall. However, the presence of suction on the slug due to the vacuum source helps to maintain the slug in a horizontal orientation, thereby allowing the cut to continue until complete separation of a slug and catheter side wall is accomplished.

After adjusting a hole cutting machine 60 to accommodate a catheter of given dimensions, a hole cutting procedure typically follows the steps of: a) energizing the vacuum source 67; b) placing a catheter tube in a cradle fixture 75 to align centerlines of the catheter and cutting tube 15; c) bringing the cutter tube 15 into piercing, partial depth engagement with the catheter side wall; d) activating the rotating coupling mechanism 63 to rotate the cutter tube 15; and e) urging the cutting tube 15 through the remainder of the catheter sidewall. After the cutting tube 15 is removed from the catheter, the catheter may be repositioned for additional holes, or a fresh catheter may be moved into position. A hole cutting cycle as outlined immediately above may take about 2.5 seconds to complete. Steps c), d), and e) are preferably automated to occur in sequence following activation of a switch (not illustrated). Suitable switches include various known hand and foot activated switches, and safety switches such as light curtains. Certain modifications may be made to the various outlined steps without departing from the invention. For example, rotating coupling mechanism 63 may rotate during the entire hole cutting operation. The process may also be further automated to increase hole production.

Additional precautions may be taken given the importance of preventing discard slugs being attached to a catheter. The sensing element 65 may be incorporated into a feedback loop to warn an operator that a slug is missing, still in a catheter, or that a hole is incomplete. A warning siren may be activated, or the machine 60 could be powered down if a slug is not sensed after the completion of the final hole cutting stroke and removal of cutting tube 15 from a catheter. A simple feedback loop may be created using a sensing element 65 and a period of time following predicted hole completion. In practice, the slug normally is whisked past sensor 65 almost simultaneously with its separation from a catheter side wall. A slug should be detected, for example, by the time the cutting tube 15 is retracted, or the slug is at risk of being inserted into a body along with the catheter.

Reference in this disclosure to specific details of the illustrated or preferred embodiments is not intended to restrict the scope of the appended claims, which themselves are intended to define the invention in terms of appropriate scope.

What is claimed is:

1. An apparatus for cutting a hole through a side wall of a catheter, comprising:

a vacuum source in fluid communication with a proximal end of a cutting tube, said cutting tube comprising:

a distal end terminating in a cutting edge;

said proximal end; and a lumen, extending between said distal and proximal ends, said lumen being of smaller diameter at said distal end than at said proximal end;

structure arranged to collect a discard slug cut from said side wall; and an assembly configured and arranged for urging said distal end of said cutting tube from an exterior surface toward an interior surface through said side wall of said catheter whereby to cut said slug from said side wall.

2. The apparatus of claim 1, further including:

discard slug detecting means disposed between said vacuum source and said cutting edge.

3. The apparatus of claim 1, wherein said lumen includes:

a first portion, extending from said cutting edge to a shoulder, said first portion having a cutting edge configuration substantially congruent with a preselected cross sectional shape of a discard slug; and a second portion, extending from said shoulder to said proximal end, said second portion having a cross sectional configuration which permits free travel of said discard slug from said shoulder to said proximal end.

4. The apparatus of claim 3, wherein said shoulder is oriented approximately parallel to said cutting edge, and said shoulder is spaced apart from said cutting edge by a distance of less than one thickness of a discard slug.

5. The apparatus of claim 1, wherein said cutting edge defines the smallest diameter of said lumen.

6. The apparatus of claim 1, further including:

a rotating coupling mechanism to receivingly engage said proximal end of said cutting tube, said rotating coupling mechanism operable to impart rotation to said cutting tube, said rotation being about a centerline axis of said cutting tube.

7. The apparatus of claim 6, wherein said assembly for urging said cutting tube through said side wall of said catheter includes:

a fast-acting mechanism to impart a first rate of linear motion to said cutting tube to bring said cutting edge into engagement with said catheter; and a slow-acting mechanism to impart a second rate of linear motion to said cutting tube to complete the cutting operation through a catheter side wall; wherein:

said first rate of linear motion is faster than said second rate of linear motion, and said linear motion is directed substantially along a centerline axis of said cutting tube.

8. The apparatus of claim 7, wherein said fast-acting and said slow-acting mechanisms comprises a single mechanism operable at different speeds.

9. The apparatus of claim 7, wherein said fast-acting and said slow-acting mechanism comprises a fluid driven piston element.

10. The apparatus of claim 7, wherein said fast-acting mechanism comprises a first fluid driven piston element and said slow-acting mechanism comprises a second fluid driven piston element.

11. The apparatus of claim 6, further including a control system to start and stop said rotating coupling mechanism.

12. The apparatus of claim 11, further including:

a fast-acting mechanism to impart a first rate of linear motion to said cutting tube to bring said cutting edge into engagement with said catheter; and a slow-acting mechanism to impart a second rate of linear motion to said cutting tube to complete the cutting operation through a catheter side wall; wherein:

said first rate of linear motion is faster than said second rate of linear motion, and said linear motion is directed substantially along a centerline axis of said cutting tube.

13. The apparatus of claim 12, wherein:

said control system, when engaged, activates said fast-acting mechanism, said rotating coupling mechanism, and said slow-acting mechanism in a sequence to cut a hole through a side wall of a catheter.

14. The apparatus of claim 11, wherein said control system is engaged by actuation of a switch means.

15. A method of cutting a hole through a side wall of a catheter, comprising the steps of:

a) adjusting a hole cutting machine to accommodate a catheter, said machine comprising a vacuum source in fluid communication with a proximal end of a cutting tube, said cutting tube comprising:
- a distal end terminating in a cutting edge;
- said proximal end; and
- a lumen, extending between said distal and proximal ends, said lumen being of smaller diameter at said distal end than at said proximal end;
- said hole cutting machine further comprising: discard slug collecting means;
- means for urging said cutting tube from an exterior surface toward an interior surface through said side wall of said catheter;
- a rotating coupling mechanism to receivingly engage said proximal end of said cutting tube, said rotating coupling mechanism operable to impart rotation to said cutting tube, said rotation being about a centerline axis of said cutting tube;

b) energizing said vacuum source;

c) placing a catheter tube in a cradle fixture to substantially align a centerline of said catheter with a centerline of said cutting tube;

d) activating said rotating coupling mechanism to rotate said cutter tube; and e) urging said cutting tube through a sidewall of said catheter.

16. The method of claim 15, further comprising, between steps c) and d):

a) bringing said cutter tube into piercing, partial depth engagement with said catheter side wall.

17. An apparatus for cutting a hole through a side wall of a catheter, comprising:

a vacuum source in fluid communication with a proximal end of a cutting tube, said cutting tube comprising:
- a distal end terminating in a cutting edge;
- said proximal end; and
- a lumen, extending between said distal and proximal ends;

means for urging said cutting tube from an exterior surface toward an interior surface through said side wall of said catheter; and discard slug detecting means configured and arranged to detect removal of a discard slug from said catheter.

18. The apparatus of claim 17, further comprising discard slug collecting means.

19. The apparatus of claim 17, said distal end having structure configured to release said discard slug following separation of said slug from said catheter for transport of said slug through said lumen, said release being accomplished by influence of said vacuum source.

20. The apparatus of claim 17, said means for urging comprising:

a mechanism configured and arranged to bring said cutting edge into partial depth, piercing engagement with said catheter at a first transverse speed, and to complete travel through said catheter wall to separate said discard slug at a second transverse speed, said first speed being faster than said second speed, and said mechanism further being capable of intermittent rotation of said cutting tool.

* * * * *